United States Patent [19]

Young

[11] 4,006,499

[45] Feb. 8, 1977

[54] HOSPITAL BED

[76] Inventor: Claude A. Young, 126 Kensington, LaGrange, Ill. 60525

[22] Filed: July 21, 1975

[21] Appl. No.: 597,422

[52] U.S. Cl. ..... 5/62; 5/66

[51] Int. Cl.[2] ..... A61G 7/10

[58] Field of Search ..... 5/60, 62, 63, 66, 68

[56] References Cited

UNITED STATES PATENTS

| | | | |
|---|---|---|---|
| 2,251,797 | 8/1941 | Leland, Jr. | 5/62 |
| 2,311,542 | 2/1943 | Holme | 5/62 |
| 3,200,416 | 8/1965 | Warrick | 5/62 |
| 3,797,050 | 3/1974 | Benoit et al. | 5/62 |

*Primary Examiner*—Casmir A. Nunberg

*Attorney, Agent, or Firm*—McWilliams & Mann

[57] ABSTRACT

A hospital bed having an underframe and a mattress support frame disposed over the underframe, with the underframe and support frame having head and foot ends at the respective ends of same and the underframe mounting a head pedestal at the head end of same, and a foot pedestal at the foot end of same, a first pair of side pedestals disposed one on either side of same at the midportion of the length of the pad, and a second pair of side pedestals disposed one on either side of same intermediate the foot pedestal and the first pair of side pedestals, and means for releasably connecting the support frame to the respective pedestals for pivotal movement with respect thereto in the form of shiftable pins for selectively pivoting the support frame for pivotal movement between opposed pairs of said pedestals. An actuator acts on the support frame to pivot same about the longitudinal or transverse axes of the bed, or about a transverse axis extending between the second pair of pedestals, depending on the conditioning of the bed arrangement by connection of the support frame to the respective pedestals.

3 Claims, 10 Drawing Figures

HOSPITAL BED

This invention relates to a hospital bed, and more particularly, to a bed suitable for hospitals, rest homes, infirmaries, and the like to facilitate the care of chronically and/or acutely ill person.

Several well-known guiding principles concerning the care of sick and invalid persons are as follows:

1. The physical and mental comfort of the patient is of paramount importance to the patient's early recovery. 2. Persons who lie in bed for extended periods of time are likely to experience decubitus ulcers (commonly known as bed sores), and the longer one lays in a reclining position the more likely he is to be subject to such problems. 3. Extended periods in a supine position, regardless of the reason, leads to increasing susceptibility to hypostatic pneumonia. 4. Bed rest of more than twenty-five hours after surgery or the like, especially for those over twenty years of age, is conductive to phlebo-thrombosis, which frequently results in pulmonary embolism.

Thus, the management of any pathological condition requiring bed rest is of prime concern to anyone involved in patient care.

Hospital beds are in general designed for significant patient comfort, but when it comes to chronically or acutely ill patients, conventional hospital and other types of invalid beds lack desirable maneuverability or adjustability that will insure maximum patient comfort and positioning best suited for his condition at any particular time. It is well known to those involved in bed patient care that bed calls for acutely or chronically ill persons that are unable to help themselves to a considerable extent involves considerable time and effort on the part of attending nurses.

Existing equipment such as the polio bed, the rotating bed, and others of known special design have provided significant assistance in special cases, but insofar as the applicant is aware, no one type of bed is so arranged to provide all needed functions for general hospital use. Thus, the functions of a number of forms of speciality beds may be required for a single patient's case, but the high cost of such equipment precludes their availability on any type of mass basis that is needed to solve the basic problem.

Guiding principles of patient care recognize that to forestall the formation of or alleviation of bed sores, for persons unable to move themselves in bed, requires that the patient be turned from side to side at least once every two hours. It often results that providing this service requires at least two nurses, depending on the size of the patient and his ability to cooperate in moving. For the totally incapacitated patient, this is invariably a difficult task under the best of conditions.

Change of position of the patient's body is also desirable from the standpoint that remaining too long in a supine position prevents bronchial secretions from being normally discharged which results in a build-up of same in the lungs and consequent hypostatic pneumonia. Similarly, early ambulation for post surgery, post delivery cases, etc. is a must to achieve adequate linear velocity of the venus blood in the lower extremities at a reasonably early time.

These situations all require movement of the body of the incapacitated person who frequently is largely incapable of assisting, either in moving himself between positions on a bed, or readying himself to leave the bed.

A principal object of the invention is to provide a hospital bed in which the mattress support frame, on which the mattress and patient rest, may be alternately tilted or pivoted about either its longitudinal central axis or its centrally located transverse axis, or again alternately, about a transverse axis that is intermediate the bed foot end and its transverse central axis, so that the bed is not only susceptible of providing Trendelenburg and reverse Trendelenburg positions, but also may be selectively rocked or pivoted from side to side or swung substantially upright.

Another principal object of the invention is to provide a hospital bed arrangement that is especially adapted to ease the taking care of chronically or critically ill persons by making the bed maneuverable in ways to facilitate patient care and treatment and nursing service relative to same as well as to provide for desirable changing of the position of the body of the patient for patient well-being and for encouragement of self-help.

A further important object of the invention is to provide a bed arrangement that permits the patient to lie flat, to lie on either side, to lie at a horizontal angle with feet or head elevated, to sit on the bed with both legs and back supported, in a stable position, or to stand upright without leaving the bed.

Yet a further object of the invention is to provide a hospital bed arrangement in which a single actuator device may provide tilting movement of the bed from side to side or end to end, including a gentle rocking acting where sleep inducement is desired.

Other objects of the invention are to provide an all-around service bed of great flexibility and use that avoids the need for many types of expensive speciality beds and that is inexpensive of manufacture, convenient and safe to use, and long lived and reliable in operation.

In accordance with this invention, the hospital bed comprises an underframe, which may be wheeled for ease of movement, and a mattress support frame, on which the bed mattress, bedding, and the patient rest, disposed above the underframe, with each of such frames defining head and foot ends at the respective ends. The bed underframe mounts a series of pedestals from which the bed support frame is adjustably supported, namely a head pedestal at the head end of the bed, a foot pedestal at the foot end of the bed, with both pedestals being on or aligned with the longitudinal center line of the bed. The underframe also mounts a pair of side pedestals on either side of the bed at the transverse center line of the bed, and a second pair of side pedestals on either side of the bed between the foot end of the bed and the first set of side pedestals. The support frame preferably is articulated and powered in the manner of conventional hospital bed support frames to define head, seat, and back portions that may be articulated for patient comfort or for specific patient treatment.

Further in accordance with the invention, selectively operable connecting pins connect the bed mattress support frame with the respective pedestals for pivotal movement relative thereto, whereby the support of the mattress support frame from the pedestals may be selectively changed between support on all four sides of the bed to pivotal support between opposed pedestals of the respective pairs of pedestals, for pivotal movement of the bed support frame as needs require. The bed arrangement includes a single actuating device for pivoting or rocking the bed support about the three pivot axes available.

The result is that the bed support frame on which the patient lies, when used flat or planar, may be horizontally disposed, may be disposed at either the Trendelenburg position, or reverse Trendelenburg position, or rocked between same, pivoted from side to side, or rocked to a substantially upright position with the feet end adjacent floor level. The bed support frame is conditioned to move as indicated by disposing the pairs of support pins to mount the bed support frame for the pivotal movement needed for each position.

The support frame may be articulated to dispose the bed support frame in the Fowler seating position or the hyperextension position, assuming that the bed support frame is appropriately articulated to achieve these positions.

Other objects, uses and advantages will be obvious or become apparent from a consideration of the following detailed description and the application drawings.

Figure 1:
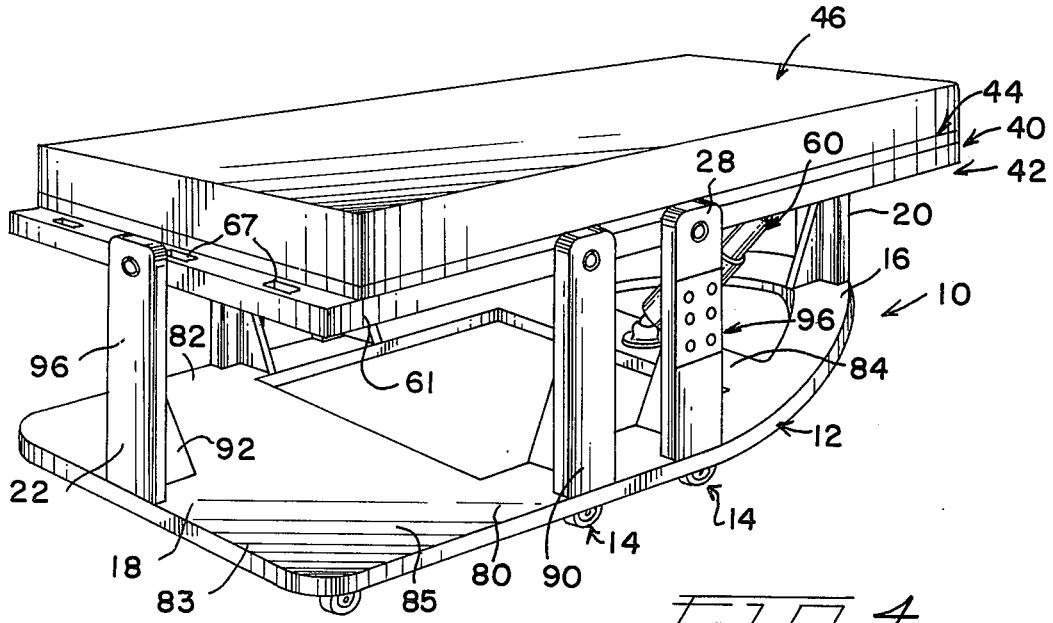
FIG. 1 is a diagrammatic perspective view illustrating an embodiment of the invention.
Figure 4:
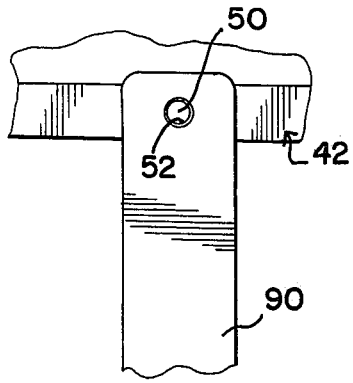
FIG. 4 is a fragmental view illustrating the manner in which the mattress support frame is supported from one of the bed underframe pedestals.

However, it is to be distinctly understood that the specific drawing illustrations provided are supplied primarily to comply with the requirements of the patent laws, and that the invention may have other embodiments that will be obvious to those skilled in the art, and which are intended to be covered by the appended claims.

GENERAL DESCRIPTION

Reference numeral 10 of the drawings generally indicates the improved hospital or invalid bed arrangement, which comprises an underframe 12 riding on suitable wheels 14 and defining head end 16 and foot end 18. The frame 12 has mounted on same a plurality of upstanding posts or pedestals comprising head end pedestal 20 and foot end pedestal 22, which are disposed along the longitudinal center line 24 of the bed 10.

Disposed on either side of the bed 10, and in alignment with the central transverse axis 26 of the bed (see FIG. 2), are side pedestals 28 and 30. Disposed between the foot end pedestal 22 and the side pedestals 28 and 30, on the respective sides of the bed, are side pedestals 32 and 34. It will thus be seen that the head and foot pedestals 20 and 22 form a pair of opposed bed end pedestals 23 while the side pedestals 28 and 30 form a pair of opposed bed side pedestals 31. Similarly, side pedestals 32 and 34 form a pair of opposed side pedestals 35.

Figures 5, 6, 7, 8, 9, 10:
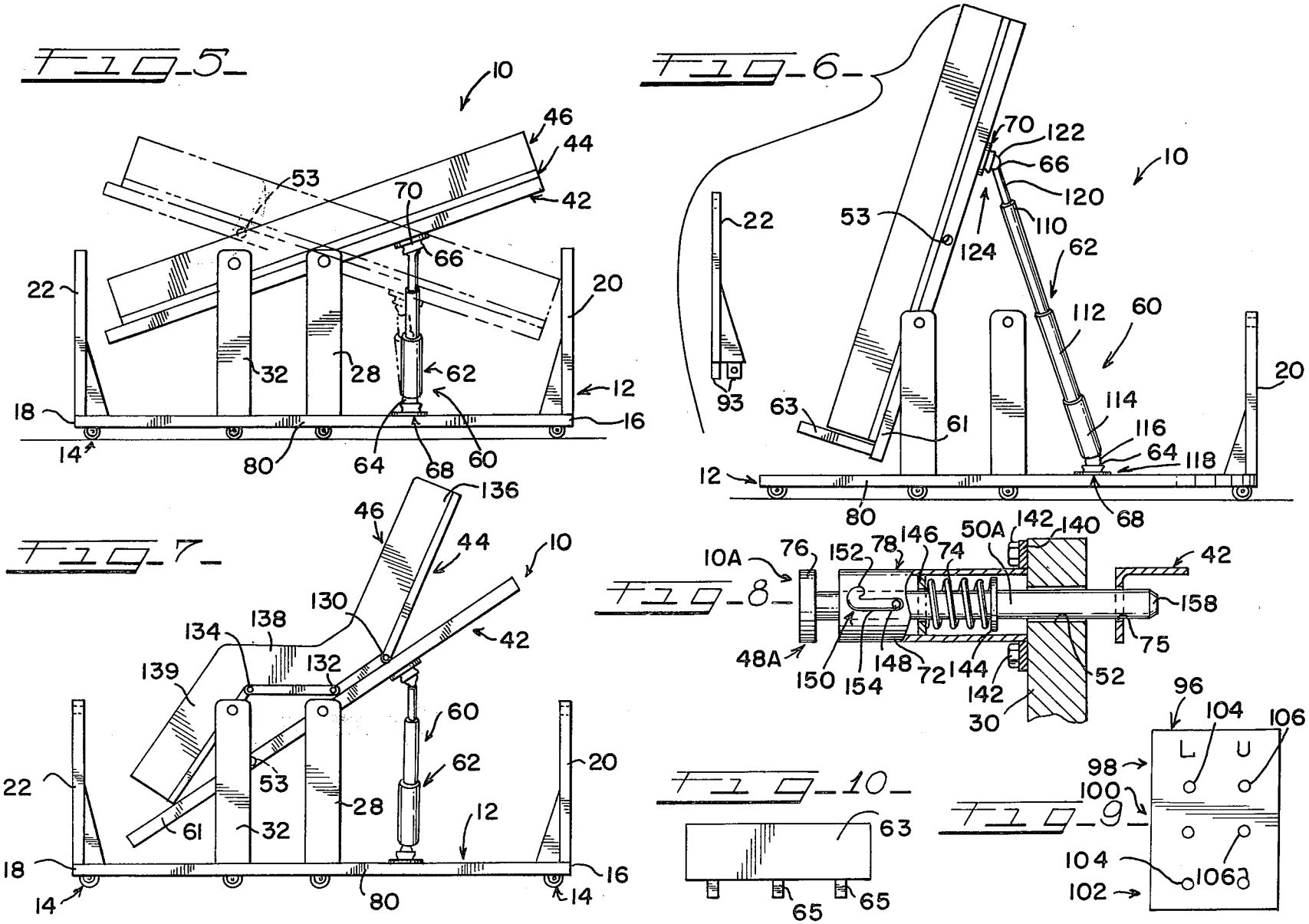
FIG. 5 is a side elevational view of the bed arrangement, showing in solid lines the bed frame when it is in reverse Trendelenburg position, and indicating in broken lines the bed in its Trendelenburg position.
FIG. 6 is a view similar to that of FIG. 5, but showing the bed frame conditioned and positioned for substantially upright positioning of the patient.
FIG. 7 is a view similar to that of FIGS. 5 and 6, but showing the bed frame conditioned and disposed to provide a sitting position for the patient.
FIG. 8 is a fragmental view illustrating an alternate form of bed frame support device that operably secures the bed support frame to the underframe pedestals.
FIG. 9 is a plan view diagrammatically illustrating a control panel arrangement for the bed.
FIG. 10 is a plan view of a footboard to be used when the bed is in its position of FIG. 6.

The pedestals of the respective pedestal pairs are spaced to receive the bed support frame 40, which is only diagrammatically illustrated, and which in practice may comprise any commercially available frame structure that defines the usual rigid base frame 42 on which is mounted the familiar articulated framework or gatch 44, powered in a conventional manner to change the bed shape between the planar position of FIG. 1 to the seat defining position of FIG. 7 and to provide downward inclination of the head or foot ends, as desired. Suitably mounted on the articulated framework 44 is a mattress and bedding which is shown in block diagram form at 46.

Figure 2:
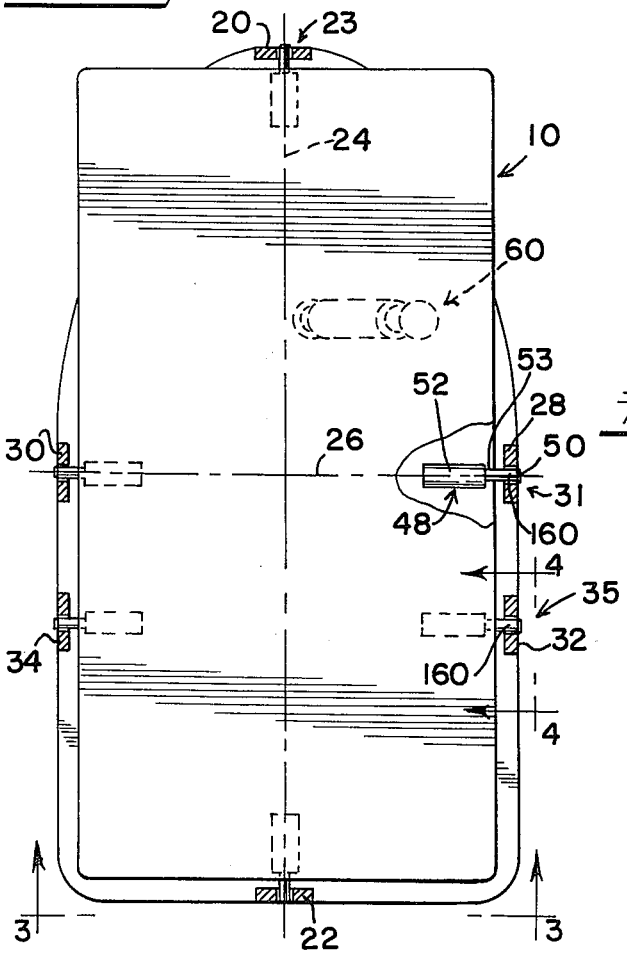
FIG. 2 is a plan view of the bed arrangement shown in FIG. 1.

The bed frame 40, in accordance with the invention, is supported by the pairs of pedestals 23, 31 and 35 through latch devices 48 of the general type indicated in FIG. 2, comprising a latch pin or bar 50 adapted to be inserted in the respective openings or apertures 52 of the respective pedestals through apertures or openings 53 of frame 42. In the form of the invention shown in FIGS. 1 – 8, the latch bars or pins 50 are part of a solenoid device 52, with the respective solenoid devices 52 being electrically wired and suitably connected to a source of electrical power to extend and retract the pins or bars 50 to and from the respective pedestal openings or apertures 52 as desired in the practice of the invention.

When the bed 10 is being used as a standard bed, all six devices 48 are set to apply their latch bars or pins 50 to the respective pedestals or apertures 52 whereby the bed support frame 40 is supported by all of the pedestals.

Operably associated between the bed frame 40 and the bed underframe 12 is a single actuator device 60 that is uniquely positioned relative to the underframe 12 and bed suport frame 40 to permit the bed support frame 40 to be shifted in the various manners indicated in the drawings, after the support of the bed support frame 40 by the pedestals has been conditioned for the particular type of movement desired by appropriate operation of the latch devices 48.

The actuator device 60 may be any suitable type of power actuated apparatus, that shown comprising a telescoping cylinder type of fluid actuated device 62 having its respective ends 64 and 66 connected to the underframe 12 and support frame 42, respectively by universal joint connecting devices 68 and 70.

In operation, when the bed 10 is to be used in its normal horizontal position, all devices 48 are positioned to apply their pins 50 to the respective pedestal openings or apertures 52 whereby the bed frame 42 and the weight it supports is supported by all six pedestals.

When it is desired to pivot the bed from side to side, as when changing bedding, or to assist in changing the position of the patient, or both, the latch devices 48 of the side pedestals are operated to retract their pins 50 from the respective side pedestals whereby the bed support frame 42 and the load it carries is supported by and between the foot and head pedestals 20 and 22 and by actuation device 60. Actuation device 60 then may be operated to shift the bed frame 42 between the broken line positions of FIG. 3 as needed by the patient treatment or bed changing etc., involved.

Similarly, where it is desired to put the frame 42 into the Trendelenburg or reverse positions, the latch devices of the pedestal pairs 23 and 35 are operated to retract their pins 50 whereby the frame 42 is supported between the pedestals 28 and 30 and by actuator device 60. Actuator device 60 is then operated to position the frame 42 as needed between or at the positions indicated in FIG. 5.

Where it is desired to provide for the patient to be able to sit up, the bed support of FIG. 5 is employed and the articulated frame 44 is actuated to achieve the bed sitting position indicated in FIG. 7, with the frame 42 being positioned as indicated so that the patient may sit substantially in a normal sitting position with support for his back and legs.

Where it is desired to condition the patient to stand upright, the frame 40 when in its horizontal position has its devices 48 operated so that those of pedestal pairs 23 and 31 are released and those of the pedestal pair 35 are locked, whereby operation of the actuation device 60 will dispose the frame 42 in the position of FIG. 6 thereby disposing the patient to be readily helped to a standing position. For this position, it is preferable to apply to the foot end 61 of frame 42 a removable footboard or plate 63 (see FIGS. 6 and 10) provided with locating studs 65 that seat in correspondingly located pockets 67 (see FIG. 1) formed in frame 42 to mount the footboard or plate in place, whereby the patient has support for his feet when the bed is in its position of FIG. 6.

It will thus be seen that an invalid bed arrangement is provided that is of maximum flexibility and use. The bed arrangement permits the patient to lie flat, to lie on either side, ot lie to any angle with head or feet elevated, to sit up as in a chair, and to stand up either for simple upright posture or preparatory to ambulation. The maneuverability of the bed arrangement brings into play the force of gravity to assist nursing service in handling the patient and the bed, and best positioning both, for the needs of the moment.

Figure 3:
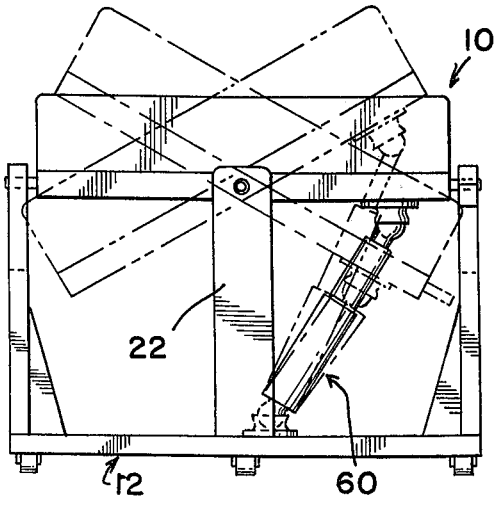
FIG. 3 is an end view of the bed arrangement of FIGS. 1 and 2, taken substantially along line 3—3 of FIG. 2, and one manner of pivotal support for the bed.

Thus, utilizing the bed adjustability indicated in FIG. 3 permits ready change of patient body position that is so necessary to avoid bed sores. Similarly, changing of the bed is greatly facilitated by this adjustability, whereby one side of the bed may be changed, the bed appropriately angled to shift the patient to the fresh side of the bed, and then the other side changed.

Utilizing the positioning of FIG. 5 for a prone patient, the bed is readily adjusted to raise or lower the head and feet as may be dictated by the need for blood circulation at either extremity.

Utilizing the positioning of FIGS. 5 – 7, nursing service is provided with a wide choice of options to position a patient for improved respiration, avoidance of pooling bronchial secretions, facilitating postural drainage and mucous expectoration, facilitating bladder and bowel voiding, and ready positioning of the patient to induce and provide confidence for ambulation, and to achieve maximum patient comfort with ready change of position and thus change of scenery being readily available.

In the embodiment of FIG. 8, the bed arrangement 10A is essentially the same as that of 10, except that the latch devices 48 are omitted and instead of modified latch device 48A of the hand operated type is applied to the invalid pedestals, for instance the pedestal 30. In this arrangement, the latch bar or pin 50A is operatively disposed within the pedestal aperture 52 and mounted within housing 72 under the biasing action of spring 74 for biasing to the latched positioned of FIG. 8 relative to the bed support frame 42, and specifically within aperture 75 formed in same. The latch bar pin 50A is provided with handle 76 to withdraw the pin or bar 50A so as to release te frame 42, with bayonet type lock 78 being provided to latch the bar or pin 50A in the unlatched position.

In accordance with this embodiment of the invention, each of the pedestals of FIG. 2 are equipped with latch device 48A, which are thus located externally of the bed and are to be manually operated in a manner that will provide the maneuverability of FIGS. 3 – 7.

SPECIFIC DESCRIPTION

The specifics of the underframe 12 and bed support frame 42 are largely optional as any suitable frame construction consistent with the objectives of the invention may be employed. In the form shown, the underframe 12 is formed from sheet metal and is open centered in nature defining side portions 80 and 82 which merge together at the head end 16 of the underframe, and which merge into foot portion 83 at the foot end of the underframe. Underframe 12 includes a tread panel portion 85 to and from which the patient may step when the bed is in its position of FIG. 6. The conventional bed head and footboards are omitted in increase accessability of those involved in nursing service or the like to the bed, and to eliminate possible obstructions to the more ambulatory patient in moving to and from the bed.

The wheels 14 may be suitable casters or the like suitably secured to the underframe to maximize maneuverability of the bed 10 insofar as movement of the bed from site to site is concerned. It is preferred that wheels 14 include suitable wheel locks that are locked when the bed 10 is being used.

The underframe includes cross portion 84 on which the actuator device 60 is mounted.

The pedestals of the pedestal pairs 23, 31 and 35 are proportioned to support the bed support frame at the height suitable above the floor for hospital beds, and for this purpose the latch devices should be in the range of from approximately 26 inches to approximately 30 inches about the floor to dispose the top of the bed at a level comparable to that of conventional hospital beds. The individual pedestals may be of any suitable sturdy construction and are shown in largely block diagram form only as upright members 90 suitably braced by suitable webs 92 connected therebetween and the underframe, and suitably formed with the lock pin receiving apertures 52 disposed in horizontal coplanar relation. In practice, the pedestals 90 may be formed from channel members or the like suitably proportioned and coated to achieve the usual standards of hospital cleanliness and appearance. Pedestal 22 is preferably removably mounted, as indicated in FIG. 6, for removal when the bed is in the position of FIG. 6 to permit the patient to have ready, unobstructed access between the bed, the tread panel portion 85, and the floor when the bed is in its position of FIG. 6. For this purpose, pedestal 22 is provided with locating studs 93 that seat in correspondingly located sockets formed in underframe 12, which are preferably suitably locked in place when the pedestal 22 is reapplied to its operative position of FIG. 1.

The latch devices 48 in practice will be suitably mounted in bed support frame 42 for projection of the respective pins or bars 50 through the openings 53 formed in same for cooperation with the apertures or openings 52 of the respective pedestals. The solenoid devices 52 of the device 48 are preferably appropriately wired for connection to a suitable control panel or the like, such as indicated in 96 on pedestal 28, in which pairs of push button controls 98, 100 and 102 are connected to control the operation of the latch devices for the respective pedestal pairs 23, 31 and 35. Such control panel 96 is more specifically illustrated in FIG. 9 as being provided with, for the respective pairs of pedestals 23, 31, 35, a control push button 104 that achieves the locked position and a control push button 106 that achieves the unlocked position. Thus, the latch devices 48 of pedestals 20 and 22 operate simultaneously to lock or unlock the bed relative to the pedestals 20 and 22 by operating push buttons 104 and 106 of push button control 98, and the same applies to the other pedestal pairs. The control panel 96 may be suitably equipped with lighting, etc. to clearly show which latch devices are opened and which are unlocked, and suitable interlocking controls may be provided to avoid undesired unlatching of a device 48, as may seem necessary or desirable for safety purposes. The solenoid devices 52 may be of any type suitable for extending and retracting pins 50 in the manner indicated.

The power operated mechanism 62 may be of any suitable type, that illustrated being in the form of telescopingly related piston cylinder sections 110, 112 and 114 that are suitably connected to a source of fluid pressure under power, which may be an electrically operated motor pump unit operably associated with the underframe in some suitable and appropriate manner (not shown).

In the form shown, the cylinder section 114 has a ball end 116 forming a part of a connecting device 68 (which is shown as being of the ball and socket type) in operative relation with the frame 12.

Cylinder section 110 is equipped with piston rod 120 formed with ball end 122 forming a part of connecting device 70 (also of the ball and socket type) in operative association with the frame 42.

In accordance with this invention, the bed support frame connected end 66 of the actuator device 60 is connected thereto at a point spaced to the head end side of the bed transverse central axis 26 and to one side of the longitudinal central axis 24. The bed underframe connected end 64 of device 60 is connected to the bed underframe to the head end side of transverse axis 26, and in the form shown, slightly to one side of the longitudinal axis 24 although in practice the underframe connected end of device 60 may be on longitudinal center line 24. Locating end 64 of device 60 as indicated permits the device 60 to have increased downward stroke of the side of the bed to which its end 66 is connected, as indicated by FIG. 3.

This orientation of the bed parts permits a single actuator device 60 to achieve all the bed movements indicated in FIGS. 3 – 7, in terms of rocking or pivotal movement with respect to the respective supporting pedestals when appropriately conditioned as has been indicated.

As has also been indicated, the articulated frame or gatch 44 may be of any suitable standard type that will achieve hospital bed type articulation, and for this purpose it may be articulated as at 130, 132 and 134, or otherwise, as is conventional in the hospital bed arts, to define head, seat and foot sections 136, 138 and 139. The frame 44 will have operably associated therewith suitable hand operated or power operated actuating means (not shown) of a conventional type to achieve this end.

In the embodiment of FIG. 8, housing 72 of latch device 48A is flanged as at 140 for securement to the respective pedestals by employing suitable fasteners, such as bolts 142. Spring 74 is interposed between a spring set 144 fixed to pin 50A and spring set 146 fixed within housing 72. The lock 78 comprises pin 148 fixed to pin 50A and operating in J-shaped slot 150 formed in the housing 72, whereby when pin 140 is seated in portion 152 of slot 150, pin 50A is retracted from opening 75 of frame 42. Handle 76 is preferably knurlled for ease of operation, it being apparent that release of pin 148 from housing slot portion 152 and disposing of same in slot portion 154 allows the biasing action of spring 74 to extend pin or bar 50A for application to an opening 75 of frame 42 aligned with same. The working end 156 of pin or bar 50A is beveled as at 158 for location functions relative to the opening 75. Pin or bar 50 is similarly formed at its working end 160.

It will therefore be seen that this invention provides an invalid bed arrangement of great maneuverability and flexibility in use and that permits patient handling to maximum benefit and comfort while achieving desired control over such patient problems as cardio or cardio-vascular diseases, respiratory impairment, bowel and/or bladder voiding difficulties, postural drainage problems, shock proneness, psychic disturbances, cerebral malfunctions (such as strokes), neurological complications, and miscellaneous pathological conditions of varied importance.

The bed arrangement is of few and simple parts, insuring the provision of a highly flexible medical tool with minimum expanse for wide use capability.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A hospital bed comprising:

a bed underframe defining head and foot ends at the respective ends of same, a mattress support frame disposed above the bed underframe and defining head and foot ends at the respective ends of same overlying the respective head and foot ends of said underframe, said bed underframe including a head end pedestal adjacent the head end of said support frame, a foot end pedestal adjacent the foot end of said support frame, a first pair of side pedestals disposed one on either side of said support frame adjacent the mid-portion of the length of same, and a second pair of side pedestals disposed one on either side of said support frame intermediate said foot end of said support frame and the respective side pedestals of said first pair of pedestals, first means for releasably connecting said support frame to said first pair of side pedestals for pivotal movement with respect thereto about aligned horizontal axes, second means for releasably connecting said support frame to said first pair of side pedestals for pivotal movement with respect thereto about aligned horizontal axes, third means for releasably connecting said support frame to said second pair of side pedestals for pivotal movement with respect thereto about aligned horizontal axes, means for selectively operating the respective connecting means to the exclusion of the remaining connecting means for conditioning said support frame for said pivotal movement about said axes of pedestals of the selected connecting means, and power means operatively interposed between said underframe and said support frame for pivoting said support frame about the pivotal axes for which said support frame has been conditioned and power means comprising:

actuating means operably connected to said support frame between said head end of same and said axes of said first pair of side pedestals, and to one side of said axes of said head and foot pedestals for pivoting said support frame about the pivotal axes for which said support frame has been conditioned, and means for actuating said actuating means, said first, second and third releasable connecting means each comprising:

a pair of opposed pin elements, and means for moving said pin elements between operative positions connecting said support frame to the respective pedestals and inoperative positions freeing said support frame for up and down movement relative thereto.

2. A hospital bed comprising:

a bed underframe defining head and foot ends at the respective ends of same, a mattress support frame disposed above the bed underframe and defining head and foot ends at the respective ends of same overlying the respective head and foot ends of said underframe, said support frame being free of support legs, said bed underframe including a head end pedestal adjacent the head end of said support frame, a foot end pedestal adjacent the foot end of said support frame, a first pair of side pedestals disposed one on either side of said support frame adjacent the midportion of the length of same, and a second pair of side pedestals disposed one on either side of said support frame intermediate said foot end of said support frame and the respective side pedestals of said first pair of pedestals, first means for releasably connecting said support frame to said first pair of side pedestals for pivotal movement with respect thereto about aligned horizontal axes, second means for releasably connecting said support frame to said first pair of side pedestals for pivotal movement with respect thereto about aligned horizontal axes, third means for releasably connecting said support frame to said second pair of side pedestals for pivotal movement with respect thereto about aligned horizontal axes, means for selectively operating the respective connecting means to the exclusion of the remaining connecting means for selectively conditioning said support frame for one of said pivotal movements and for selectively operating the respective connecting means to support said support frame from all said pedestals and against any of said pivotal movements, and power means operatively interposed between said underframe and said support frame for pivoting said support frame about the pivotal axes for which said support frame has been conditioned, said power means comprising:

actuating means operably connected to said support frame between said head end of same and said axes of said first pair of side pedestals, and to one side of said axes of said head and foot pedestals for pivoting said support frame about the pivotal axes for which said support frame has been conditioned, and means for motivating said acutating means, said acutating means comprising:

a single extendable and retractable actuating device interposed between said bed underframe and said support frame, said actuating device being mounted on said underframe adjacent the longitudinal axis of same and between said head end of said underframe and the midportion of the length of said underframe.

3. The hospital bed set forth in claim 2 wherein:

said actuating device is connected to said underframe and said support frame by universal joint type connecting devices.

* * * * *